US009975117B2

(12) United States Patent
Lee et al.

(10) Patent No.: US 9,975,117 B2
(45) Date of Patent: May 22, 2018

(54) APPARATUS AND METHOD FOR CONTROLLING DROPLET

(71) Applicant: Industry-Academic Cooperation Foundation, Yonsei University, Seoul (KR)

(72) Inventors: Taeyoon Lee, Seoul (KR); Jonghyun Ahn, Seoul (KR); Jungmok Seo, Goyang-si (KR); Seoung Ki Lee, Seoul (KR)

(73) Assignee: Industry-Academic Cooperation Foundation, Yonsei University (KR)

( * ) Notice: Subject to any disclaimer, the term of this patent is extended or adjusted under 35 U.S.C. 154(b) by 0 days. days.

(21) Appl. No.: 15/147,132

(22) Filed: May 5, 2016

(65) Prior Publication Data

US 2016/0325276 A1 Nov. 10, 2016

(30) Foreign Application Priority Data

May 7, 2015 (KR) ..... 10-2015-0063715

(51) Int. Cl.
*B01L 3/00* (2006.01)

(52) U.S. Cl.
CPC ..... *B01L 3/502* (2013.01); *B01L 3/5088* (2013.01); *B01L 3/50273* (2013.01); *B01L 3/502792* (2013.01); *B01L 2200/06* (2013.01); *B01L 2200/0642* (2013.01); *B01L 2200/10* (2013.01); *B01L 2300/123* (2013.01); *B01L 2400/0457* (2013.01); *B01L 2400/0475* (2013.01)

(58) Field of Classification Search
CPC .... B01L 3/502; B01L 3/50; B01L 3/00; B01L 3/5088; B01L 3/508; B01L 2200/0642; B01L 2200/06
USPC ..... 422/504, 502, 501, 500, 50; 436/180, 436/174
See application file for complete search history.

(56) References Cited

U.S. PATENT DOCUMENTS 4,281,618 A 8/1981 Fenimore

FOREIGN PATENT DOCUMENTS

JP 09-170973 6/1997
KR 101358831 B1 2/2014

OTHER PUBLICATIONS

Seo et al, Path-programmable water droplet manipulations on an adhesion controlled superhydrophobic surface, Nature, Jan. 23, 2015 received and Jul. 23, 2015 published, 5:12326, pp. 1-6.*

(Continued)

*Primary Examiner* — Christine T Mui
(74) *Attorney, Agent, or Firm* — Harness, Dickey & Pierce, P.L.C.

(57) ABSTRACT

Provided is an apparatus and method for controlling a droplet. The apparatus for controlling the droplet does not contaminate/damage a sample, has a high degree of freedom in droplet control, and is capable of being repeatedly used for a long time. An apparatus (100) for controlling a droplet according to an embodiment includes a flexible substrate (120) having a hydrophobic or oleophobic surface, a dimple formation unit (140), which locally deforms a bottom surface of the flexible substrate (120) to form a dimple, and a driving unit (160), which moves the dimple formation unit (140) at a lower side of the flexible substrate.

9 Claims, 8 Drawing Sheets

(56) References Cited

OTHER PUBLICATIONS

Supplemental Information of Seo et al, Path-programmable water droplet manipulations on an adhesion controlled superhydrophobic surface, Nature, Jan. 23, 2015 received and Jul. 23, 2015 published, 5:12326, pp. 1-9.*

C. J. Huang et al., "A biocompatible open-surface droplet manipulation platform for detection of multi-nucleotide polymorphism," The Royal Society of Chemistry, Lab Chip, 2014, pp. 2057-2062.

* cited by examiner

APPARATUS AND METHOD FOR CONTROLLING DROPLET

CROSS-REFERENCE TO RELATED APPLICATIONS

This U.S. non-provisional patent application claims priority under 35 U.S.C. § 119 of Korean Patent Application No. 10-2015-0063715, filed on May 7, 2015, the entire contents of which are hereby incorporated by reference.

BACKGROUND

The present disclosure herein relates to an apparatus and method for controlling a droplet, and more particularly, to an apparatus and method for freely controlling movement, stop, and mixing of a droplet.

A lab-on-a-chip (LOC) technology has advantages in that chemical synthesis and analysis processes are performed in one chip by using a small amount of sample to improve efficiency and accuracy. Thus, the LOC technology is in the spotlight as a technology that is suitable for next-generation fields such as nano-bio technologies and nano-bio medical technologies. To manufacture an LOC, technologies for manufacturing a microstructure and microfluidic adjusting and droplet control technologies for inducing and adjusting reaction of a sample with a reagent in the manufactured microstructure are required.

Existing representative fluidic adjusting technologies have been studied by a method in which a fluid continuously flows through a microchannel constituted by a micropump, a valve, and a mixer. However, the development speed of the fluidic adjusting technologies is slowed down due to fundamental limitations such as a complex mechanism, a limited flow rate, and a limitation of reconfigurability in the fluidic adjusting technologies. As an alternative method, an open LOC based on a droplet control technology which is capable of quantifying and controlling a much smaller amount of sample and inducing rapid reaction is being magnified as a new measure.

So far, the droplet control technology is based on a method electrowetting, a method using dielectricphoresis, a method using magnetic force, a light-induced actuation method, and the like. However, since external stimulation is required for controlling a droplet, the sample may be damaged, and also, the degree of freedom of the control may be deteriorated due to the complex system. In addition, the sample may be contaminated and damaged. Thus, a new droplet control technology that is applicable to fields such as medicine and biotechnology by minimizing the stimulation and contamination, which cause the damage of the sample, is needed.

SUMMARY

The present disclosure provides an apparatus for controlling a droplet, which has a high degree of freedom in droplet control, does not contaminate/damage a sample, and is capable of being repeatedly used for a long time, and a method for controlling the droplet.

The present disclosure also provide an apparatus for controlling a droplet, which is capable of adjusting a diameter of a vacuum tip and a degree of vacuum in the vacuum tip to freely adjust a size and shape of a dimple and to control a droplet volume.

The objects of the inventive concept are not limited to the abovementioned objects. Other objects thereof will be understandable by those skilled in the art from the following descriptions.

An embodiment of the inventive concept provides an apparatus for controlling a droplet, the apparatus including: a flexible substrate having a hydrophobic or oleophobic surface; and a dimple formation unit configured to locally deform a bottom surface of the flexible substrate, thereby forming a dimple.

In an embodiment, the dimple formation unit may include a vacuum tip, which suctions the bottom surface of the flexible substrate to locally mechanically deform the bottom surface.

In an embodiment, the vacuum tip may have a structure of a circular shaped cross section.

In an embodiment, the vacuum tip may contact the bottom surface of the flexible substrate.

In an embodiment, the dimple formation unit may include a vacuum adjusting part configured to adjust a pressure of a space between the vacuum tip and the flexible substrate.

In an embodiment, the vacuum adjusting part may adjust a degree of vacuum of the vacuum tip to adjust a shape of the dimple.

In an embodiment, the dimple may have a size that varies according to an inner diameter of the vacuum tip.

In an embodiment, the apparatus may further include a driving unit configured to move the vacuum tip at a lower side of the flexible substrate.

In an embodiment, the driving unit may move the vacuum tip to move the droplet within the dimple on the flexible substrate.

In an embodiment, in the apparatus for controlling the droplet, a pattern part having a hydrophilic or oleophilic property may be disposed in the form of a predetermined pattern on a top surface of the flexible substrate.

In an embodiment, when the flexible substrate has the hydrophobic surface, the pattern part may have the hydrophilic property, and when the flexible substrate has the oleophobic surface, the pattern part may have the oleophilic property.

In an embodiment, the driving unit may move the vacuum tip along the predetermined pattern.

In an embodiment, the dimple formation unit may fix the droplet within the dimple.

In an embodiment of the inventive concept, a method for controlling a droplet includes: locally deforming a flexible substrate having a hydrophobic or oleophobic surface by using a dimple formation unit to form a dimple; and moving the dimple formation unit to move the droplet within the dimple.

In an embodiment, the forming of the dimple may include suctioning a bottom surface of the flexible substrate by using a vacuum tip of the dimple formation unit to locally mechanically deform the flexible substrate.

In an embodiment, in the forming of the dimple, a degree of vacuum of the vacuum tip may be adjusted to adjust a shape of the dimple.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
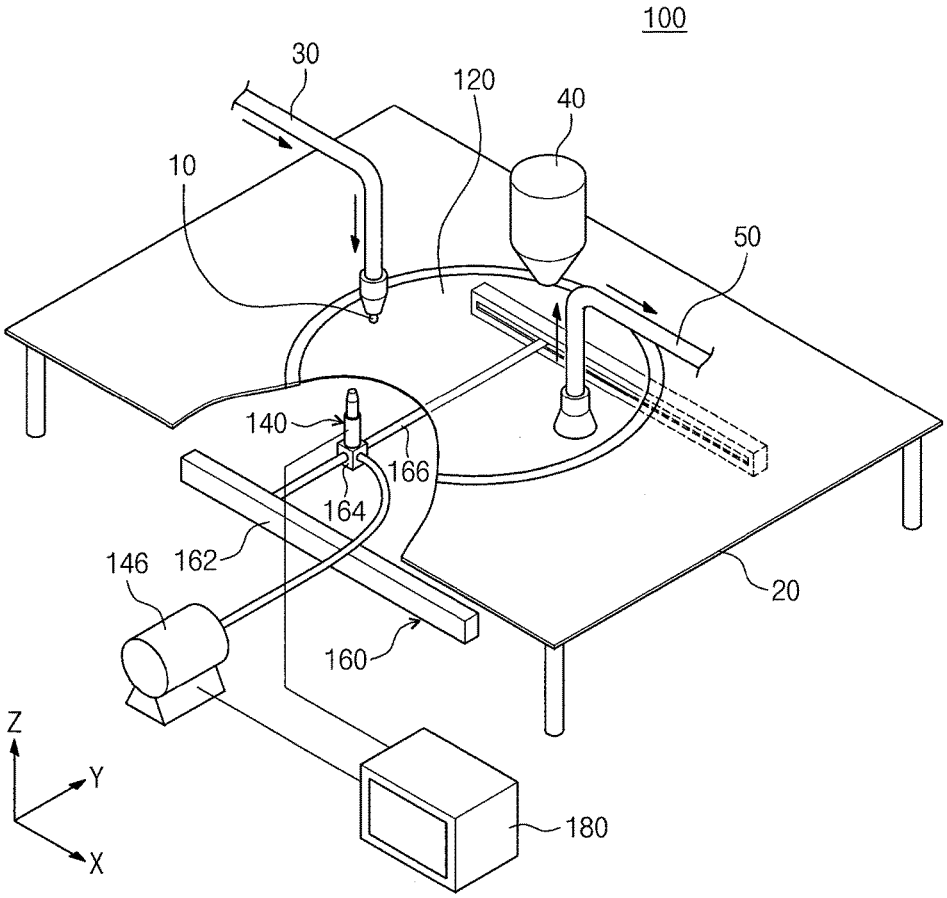
FIG. 1 is a partial cut-away perspective view of an apparatus for controlling a droplet according to an embodiment of the inventive concept.

Advantages and features of the inventive concept, and implementation methods thereof will be clarified through following embodiments described with reference to the accompanying drawings. The present disclosure may, however, be embodied in different forms and should not be construed as limited to the embodiments set forth herein. Unless otherwise defined, all terms (including technical and scientific terms) used herein have the same meaning as generally understood by those skilled in the art. Moreover, detailed descriptions related to well-known functions or configurations will be ruled out in order not to unnecessarily obscure subject matters of the inventive concept. It is also noted that like reference numerals denote like elements in appreciating the drawings. A portion of components in the drawings may be exaggerated or reduced for helping understanding of the inventive concept.

In the following description, the technical terms are used only for explaining a specific exemplary embodiment while not limiting the inventive concept. The terms of a singular form may include plural forms unless referred to the contrary. The meaning of 'include' or 'comprise' specifies a property, a region, a fixed number, a step, a process, an element and/or a component but does not exclude other properties, regions, fixed numbers, steps, processes, elements and/or components.

An apparatus for controlling a droplet according to embodiments of the inventive concept induces mechanical deformation (bending) on a hydrophobic or oleophobic surface of a flexible substrate to locally form a dimple, thereby controlling the droplet. That is, the apparatus for controlling the droplet according to the embodiments of the inventive concept may form a hydrophobic or oleophobic surface on a thin flexible surface that is stretchable or bendable to apply mechanical force on the hydrophobic or oleophobic surface and thus to locally form a dimple, thereby freely controlling movement, stop, and mixing of the droplet.

FIG. 1 is a partial cut-away perspective view of an apparatus for controlling a droplet according to an embodiment of the inventive concept. Referring to FIG. 1, an apparatus 100 for controlling a droplet according to an embodiment of the inventive concept includes a flexible substrate 120, a dimple formation unit 140, a driving unit 160, and a control unit 180.

A bendable or stretchable substrate having flexibility may be provided as the flexible substrate 120. The flexible substrate may have flexibility that is enough to locally form a dimple on a surface thereof. The flexible substrate 120 may have a hydrophobic surface on a top surface thereof. Thus, a droplet 10 may be well slid along the surface of the flexible substrate 120.

The flexible substrate 120 may be horizontally supported by a holder 20. That is, the flexible substrate 120 may be provided in an opening that is defined in a central portion of the holder 20. A space through which a vacuum tip of the dimple formation unit 140 is movable may be defined under the flexible substrate 120 by the holder 20.

A water drop, an oil drop, or other various kinds of fluids may be used as the droplet 10. The droplet 10 may include various biomaterials or chemical materials, which are objects to be analyzed, such as a DNA, protein, an antibody, a sugar chain, a cell, a neuron, and blood.

The droplet 10 may be provided to the surface of the flexible substrate 120 through a sample supply part 30. According to an embodiment, the sample supply part 30 may apply an oil pressure to a sample supply tube by using a micropump to supply a minimum amount of droplet 10 required for analysis onto the surface of the flexible substrate 120.

According to an embodiment, the flexible substrate 120 may have a hydrophobic or oleophobic surface having a contact angle of about 90° or more with respect to the droplet (e.g., water drop or oil drop) on the top surface thereof. More particularly, the flexible substrate 120 may have a superhydrophobic or superoleophobic surface having a contact angle of about 150° or more with respect to the droplet.

The hydrophobic or oleophobic surface may be formed through various methods in which the flexible substrate 120 is manufactured using a hydrophobic or oleophobic material, hydrophobic or oleophobic coating treatment is performed on the surface of the flexible substrate 120, or a nanostructure for forming the hydrophobic or oleophobic surface is formed on the surface of the flexible substrate 120.

Figure 2:
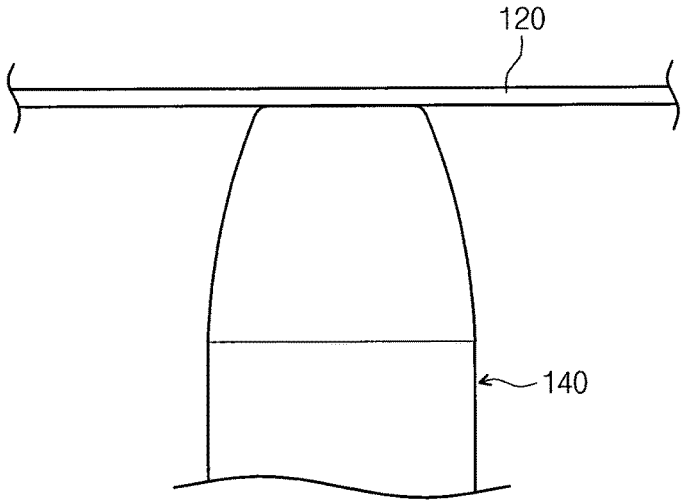
FIGS. 2 and 3 are views for explaining an operation of a dimple formation unit constituting the apparatus for controlling the droplet according to an embodiment of the inventive concept.
Figure 3:
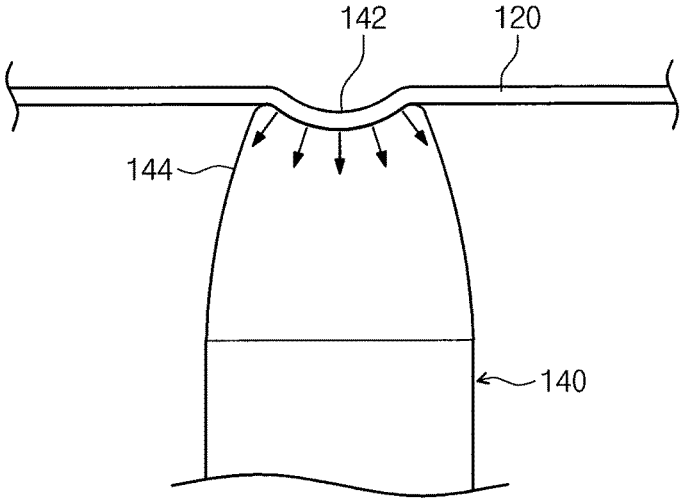

FIGS. 2 and 3 are views for explaining an operation of the dimple formation unit 140 constituting the apparatus for controlling the droplet according to an embodiment of the inventive concept. Referring to FIGS. 1 to 3, the dimple formation unit 140 may locally deform a bottom surface of the flexible substrate 120 to form a dimple 142 as illustrated in FIG. 3. The dimple formation unit 140 may be provided for fixing the droplet 10 within the dimple 142.

The dimple formation unit 140 may include a vacuum tip 144. The vacuum tip 144 may contact the bottom surface of the flexible substrate 120 to suction the bottom surface of the flexible substrate 120, thereby locally deforming the flexible substrate 120.

The vacuum tip 144 may have an approximately cylindrical shape and also have a tip structure having a circular cross-section on an upper portion thereof. Thus, the dimple 142 may have a shape that is recessed in a circular puddle shape. Here, the droplet 10 may be fixed within the dimple 142.

The dimple formation unit 140 may include a vacuum adjusting part 146 for adjusting a degree of vacuum of the vacuum tip 144. The vacuum adjusting part 146 may adjust the degree of vacuum of the vacuum tip 144 to adjust a size and shape of the dimple 142. The vacuum adjusting part 146 may be provided as a vacuum pump.

A space between the vacuum tip 144 and the flexible substrate 120 may become a vacuum state or a low vacuum state that is less than an external pressure (e.g., an atmospheric pressure). Thus, the dimple may be locally formed on the flexible substrate 120 by a difference in pressure between the top and bottom surfaces of the flexible substrate 120.

The vacuum tip 144 may have a size corresponding to that of the dimple 142. Thus, the vacuum tip 144 having an opening with various diameters may be replaced to adjust the size and shape of the dimple 142 and thus control the droplet volume.

When the vacuum tip 144 is disposed under the superhydrophobic surface of the flexible substrate 120 according to the current embodiment to form a structure of the dimple 142 having the puddle shape, the droplet 10 is fixed within the structure of the dimple 142 by characteristics of the hydrophobic or oleophobic surface.

When the suctioning operation of the dimple formation unit 140 is stopped to remove the dimple 142 from the flexible substrate 120, the flexible substrate 120 may return to its original shape by superior flexibility thereof as illustrated in FIG. 2.

Figure 4:
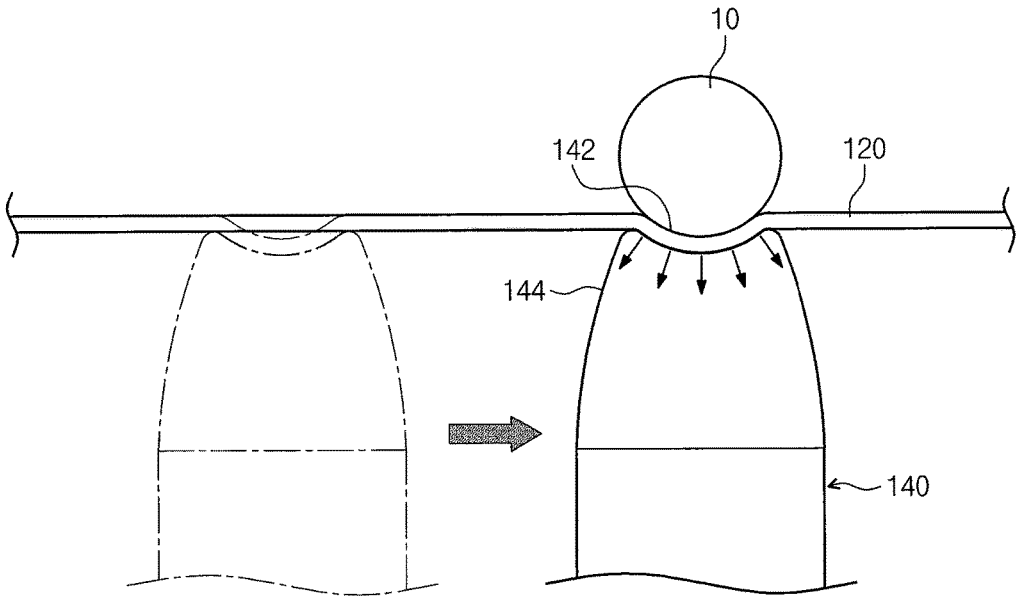
FIG. 4 is a view illustrating a state in which the droplet moves by a driving unit constituting the apparatus for controlling the droplet according to an embodiment of the inventive concept.

FIG. 4 is a view illustrating a state in which the droplet 10 moves by the driving unit 160 constituting the apparatus for controlling the droplet according to an embodiment of the inventive concept. Referring to FIGS. 1 to 4, the driving unit 160 may move the dimple formation unit 140 at a lower side of the flexible substrate 120 while the dimple formation unit 140 performs the suctioning operation.

Since the dimple formation unit 140 is horizontally moved by the driving unit 160, a position of the dimple 142 to be formed on the flexible substrate 120 may be changed, and thus, the droplet 10 within the dimple 142 may be moved on the flexible substrate 120. As described above, the driving unit 160 may move the droplet 10 within the dimple 142 on the flexible substrate 120.

The driving unit 160 may be provided in the form of an XY stage. The driving unit 160 may be provided as various mechanical mechanisms such as a driving motor or a hydraulic cylinder. According to an embodiment, the driving unit 160 includes a first guide member 162, a second guide member 166, and a movable member 164. The first guide member 162 is disposed in a first direction to drive the second guide member 166 in the first direction. The second guide member 166 is disposed in a second direction perpendicular to the first direction to move in the second direction along the first guide member 162.

The movable member 164 may be moved in the first direction along the first guide member 162 together with the second guide member 166 and moved in the second direction along the second guide member 166. An elevation member for elevating the vacuum tip 144 may be disposed on the movable member 164. Thus, the vacuum tip 144 may be driven along X-Y-Z axes.

The control unit 180 controls the dimple formation unit 140 and the driving unit 160. The control unit 180 may transmit a command to the dimple formation unit 140 and the driving unit 160 according to a user's input through preset program or a user interface unit (e.g., a mouse, a keyboard, a touch pad, and the like). The dimple formation unit 140 may start or stop the vacuum suction thereof according to the command of the control unit 180. The driving unit 160 moves a position of the vacuum tip 144 according to the command of the control unit 180.

Here, an inclination of a side surface of the dimple 142 may be controlled at an angle that is greater than a critical inclination at which the droplet 10 is rolled down by the gravity. The movement of the droplet 10 may be freely controlled according to a path along which the vacuum tip 144 is moved.

According to an embodiment, the driving unit 160 may operate to move the droplet 10 to an analysis part 40 in the state in which the dimple 142 is formed by the dimple formation unit 140. After the droplet 10 is completely analyzed by the analysis part 40, the droplet 10 may be moved to a sample discharge part 50. The analyzed droplet 10 may be discharged through the sample discharge part 50.

Since the existing droplet manipulation technologies are developed by using a mechanical valve, heat, electromagnetic fields, and an acoustic wave as a manipulation unit, the droplet manipulation technologies may be complicated in use, and an additional additive may be required. Thus, it may be difficult to accurately adjust a target droplet, and also, the droplet may be unintentionally lost or contaminated during the manipulation.

According to the current embodiment, a remaining droplet may not exist on a moving path along which the droplet 10 passes after the droplet 10 is moved by the movement of the structure of the dimple 142. Thus, since the loss of the droplet 10 and the reaction with the surface of the flexible substrate 120 during the movement of the droplet 10 are reduced, when the apparatus for controlling the droplet according to an embodiment of the inventive concept is applied to a lap-on-a-chip (LOC) technology that is necessary for various syntheses and analyses, the apparatus for controlling the droplet may have great advantages.

Thus, the apparatus for controlling the droplet according to the current embodiment may be suitable for utilization in nanoparticle and bio fields, to which it is difficult to apply the existing technologies, because the apparatus for controlling the droplet is simple to use and does not cause deterioration of the sample.

Also, according to the current embodiment, the vacuum tip 144 may be adjusted in diameter to adjust a size and shape of the structure of the dimple 142, thereby controlling the droplet volume. Also, if several vacuum tips are provided to be independently moved, a plurality of droplets may be controlled at the same time, and thus, the apparatus for controlling the droplet may be easily applied and expanded to various fields.

In the droplet control technology according to the current embodiment, since it is unnecessary to designate an additional path along which the droplet is moved or add an additive, unlike the existing methods, the droplet may be freely moved, and particularly, the contamination and loss of the droplet may be significantly reduced by using the superhydrophobic or superoleophobic surface.

Figure 5:
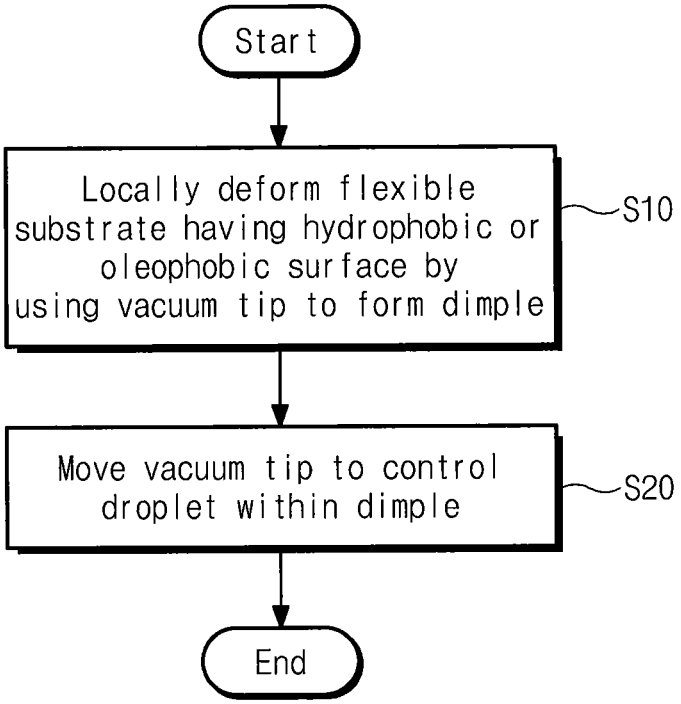
FIG. 5 is a flowchart of a method for controlling a droplet according to an embodiment of the inventive concept.

FIG. 5 is a flowchart of a method for controlling a droplet according to an embodiment of the inventive concept. Referring to FIGS. 1 to 5, a method for controlling a droplet according to an embodiment of the inventive concept includes a process (S10) of locally deforming a flexible substrate 120 having a hydrophobic or oleophobic surface by using a vacuum tip to form a dimple and a process of moving the vacuum tip to move a droplet 10 within the dimple 142.

In operation S10, a dimple formation unit 140 may suction a bottom surface of the flexible substrate 120 by using a vacuum tip 144 to locally mechanically deform the flexible substrate 120. Here, the dimple formation unit 140 may adjust a degree of vacuum of the vacuum tip 144 to adjust a shape of the dimple 142.

To quickly control the droplet, the vacuum tip 144 may stand by a position at which the droplet is initially supplied. The process of supplying the droplet 10 to the flexible substrate 120 may be performed before or after the dimple is formed on the flexible substrate 120.

In operation S20, the droplet 10 may be efficiently moved on the surface of the flexible substrate 120 by movement of a structure of a dimple 142 due to the movement of the vacuum tip 144. For example, the reciprocating movement of the vacuum tip 144 may be repeatedly performed to mix the droplet 10, or the vacuum tip 144 may be moved to move the droplet 10 or mix the droplet 10 with other droplets. A liquid does not remain on a path, along which the droplet 10 passes, by hydrophobic or oleophobic surface characteristics while the droplet 10 is moved.

Figure 6:
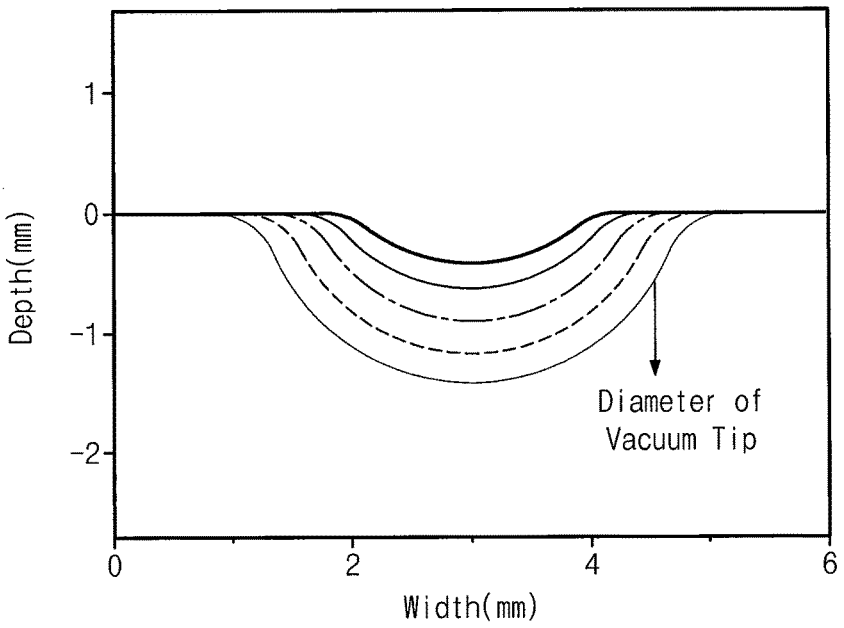
FIG. 6 is a graph illustrating a variation in shape of a dimple depending on an inner diameter of a vacuum tip.

FIG. 6 is a graph illustrating a variation in shape of the dimple depending on an inner diameter of the vacuum tip. Referring to FIG. 6, as the vacuum tip increases in inner diameter, the dimple may increase in width and depth. Thus, the dimple may be adjusted in shape according to the inner diameter of the vacuum tip, and also, the droplet may be adjusted in volume.

Figure 7:
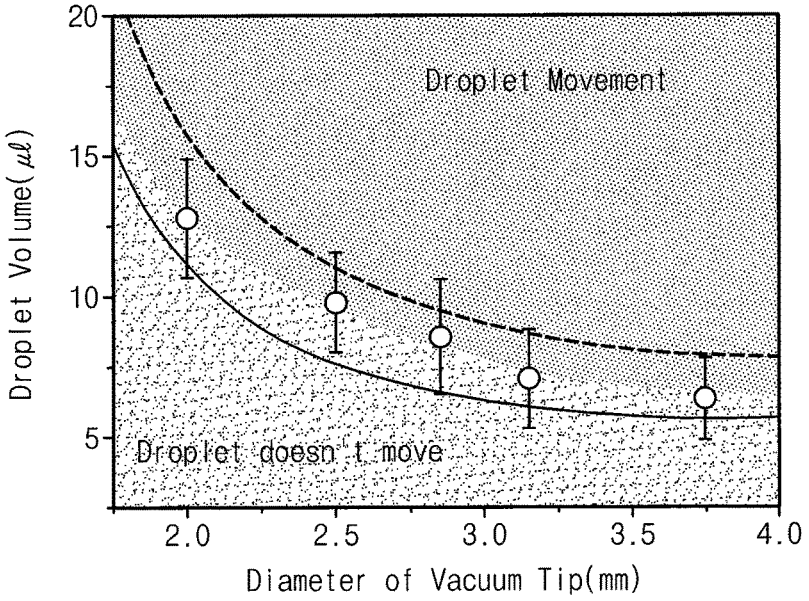
FIG. 7 is a graph illustrating a volume of a droplet that is controllable according to a width of the vacuum tip.

FIG. 7 is a graph illustrating a volume of the droplet that is controllable according to a width of the vacuum tip. Referring to FIG. 7, the more a width of the vacuum tip increases, the more a minimum volume of the controllable droplet may decrease. Thus, the volume of the droplet may be adjusted according to the width of the vacuum tip in consideration of the volume of the controllable droplet, or a vacuum tip having an adequate diameter may be used according to the volume of the droplet. When the volume of the droplet is greater than a minimum value of the movable droplet, the droplet may be movable by surface tension thereof.

According to an embodiment of the inventive concept, since an additional pattern or channel for designating the path of the droplet is not required, the droplet may be freely moved on the surface of the flexible substrate. In addition, since a loss of the droplet is less, the droplet may be controlled based on a minimum amount of sample.

In the droplet control technology according to the current embodiment, since possibility of the contamination/deterioration of the sample may be low, technologies for real time/non-real time detection of a sample to be analyzed and RNA transfer, which are difficult to be realized in the existing LOC, may be successively realized. Thus, the drop control technologies according to the current embodiment may be suitable for application fields including chemical synthesis and cell culture and various nanoparticle and bio fields.

Also, in the droplet control technology according to the current embodiment, since electrical/chemical stimulation is unnecessary, unlike the existing droplet control technologies, and the droplet control technology is applicable to the most LOC application fields including a microreactor, a bio chemical sensor, bio electronics, and laboratory medicine, its industrial applicability may be high.

Figure 8:
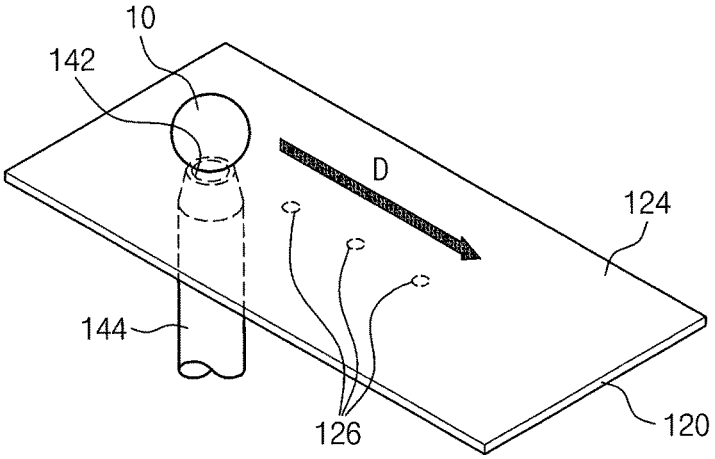
FIG. 8 is a perspective view illustrating a portion of an apparatus for controlling a droplet according to another embodiment of the inventive concept.

FIG. 8 is a perspective view illustrating a portion of an apparatus for controlling a droplet according to another embodiment of the inventive concept. In description of an embodiment of FIG. 8, duplicated description with respect to the same or corresponding component as that according to the foregoing embodiment may be omitted.

An embodiment of FIG. 8 is different from the foregoing embodiment in that a pattern part 126 having a hydrophilic or oleophilic property is formed on a top surface of a flexible substrate 120.

The flexible substrate 120 may be provided as a flexible substrate such as, for example, polydimethylsiloxane (PDMS). The flexible substrate 120 may be supported by the holder in a state in which the substrate 120 is strainedly pulled and thus be horizontally disposed.

For example, when a surface 124 of the flexible substrate 120 has a hydrophobic property, the pattern part 126 may have a hydrophobic property. For another example, when the surface of the flexible substrate 120 has an oleophobic property, the pattern part 126 may have an oleophilic property.

According to an embodiment, the pattern part 126 may have a hydrophilic or oleophilic surface having a contact angle of about 900 or less with respect to a droplet (water drop or oil drop). The pattern part 126 may have a superhydrophilic or superoleophilic surface having a contact angle of about 30° or less with respect to the droplet.

Figure 9:
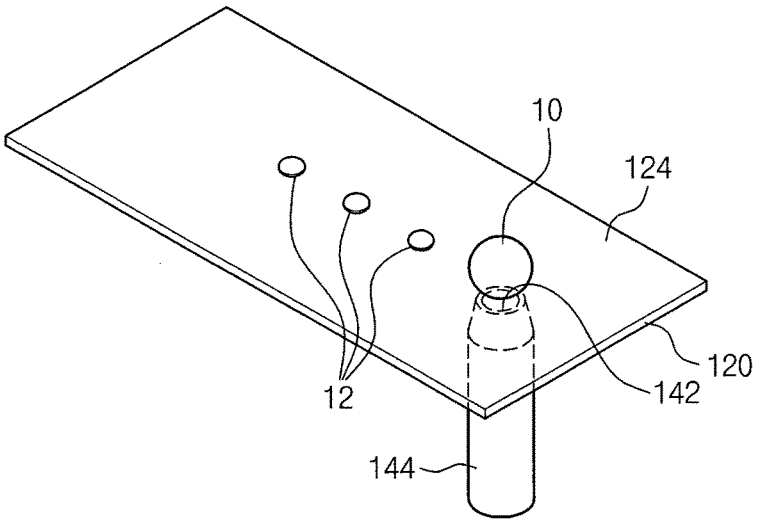
FIG. 9 is a view illustrating a state in which a microdroplet pattern 12 is formed on a flexible substrate according to the embodiment of FIG. 8.

A driving unit may move a vacuum tip 144 along a predetermined pattern in a first direction D. FIG. 9 is a view illustrating a state in which a microdroplet pattern 12 is formed on the flexible substrate according to the embodiment of FIG. 8. Referring to FIGS. 8 and 9, as a vacuum tip 144 is moved along a pattern of a pattern part 126, a dimple 142 and a droplet 10 are moved along the pattern part 126.

For example, when the droplet 10 contains water, a flexible substrate 120 may have a hydrophobic surface 124, and the pattern part 126 may have a hydrophilic property. While the droplet 10 is moved along the pattern of the pattern part 126, a portion of the droplet 10 may remain on the pattern part 126 having the hydrophilic property, and a microdroplet pattern 12 as illustrated in FIG. 9 may be obtained.

For another example, when the droplet 10 contains oil, the flexible substrate may have an oleophobic surface 124, and the pattern may have an oleophilic property. While the droplet 10 is moved along the pattern of the pattern part 126, a portion of the droplet 10 may remain on the pattern part 126 having the oleophilic property, and a microdroplet pattern 12 as illustrated in FIG. 9 may be obtained.

Figure 10:
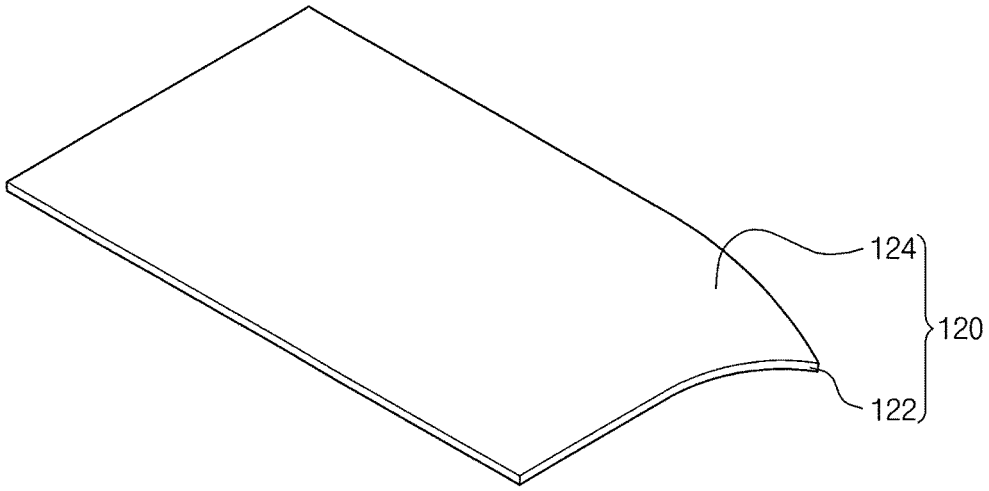
FIGS. 10 to 12 are views illustrating a process of manufacturing the flexible substrate according to the embodiment of FIG. 8.
Figure 11:
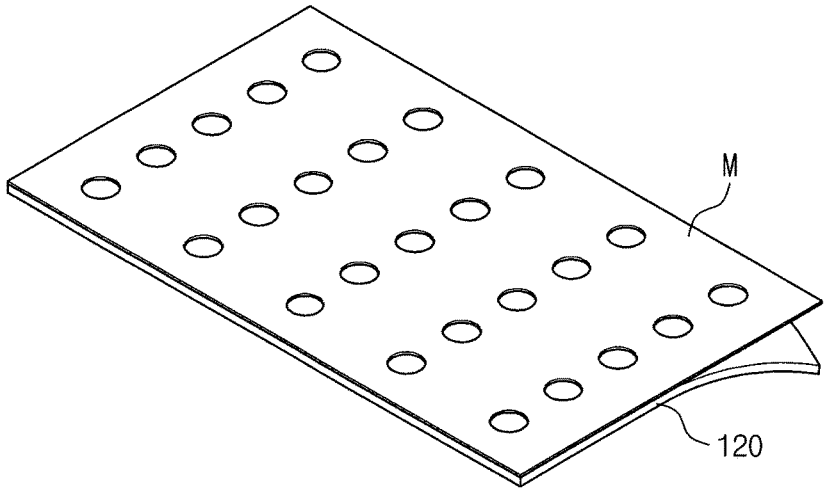
Figure 12:
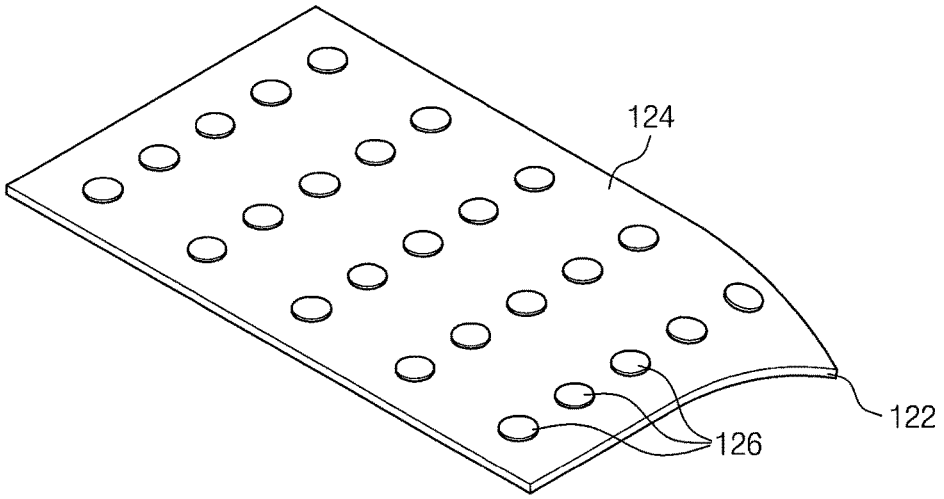

FIGS. 10 to 12 are views illustrating a process of manufacturing the flexible substrate according to the embodiment of FIG. 8. Referring to FIG. 10, after a bonding material is sprayed on a substrate 122 having flexibility, hydrophobic or oleophobic nanoparticles may be applied to obtain a substrate 120 having a hydrophobic or oleophobic surface 124.

Subsequently, as illustrated in FIG. 11, a pattern mask M may be disposed on the flexible substrate 120, and oxygen plasma treatment is performed. Then, the mask pattern M may be removed to form a pattern part 126 having the hydrophilic or oleophilic property in the form of a predetermined pattern on a top surface of the flexible substrate 120, as illustrated in FIG. 12.

As described above, when the flexible substrate 120 having the hydrophilic or oleophilic pattern is applied to the apparatus for controlling the droplet, the microdroplet pattern may be formed. The apparatus for controlling the droplet according to the current embodiment may be applicable to bio diagnostic fields such as multi bio-detection fields or other various fields in the way that the microdroplet pattern is used as a reagent, or the microdroplet pattern reacts with a reagent formed on the hydrophilic or oleophilic pattern.

In the foregoing embodiments, although the pattern is formed on the hydrophobic or oleophobic flexible substrate by using the oxygen plasma treatment, an embodiment of the inventive concept is not limited thereto. For example, the pattern part may be formed through various methods. For example, in the state in which the pattern mask is disposed on the substrate having the hydrophilic or oleophilic surface, hydrophobic or oleophobic coating may be performed on the substrate to form the pattern. Alternatively, a hydrophilic or oleophilic material may be applied to the hydrophobic or oleophobic substrate to form the pattern.

According to the embodiments of the inventive concept, the apparatus for controlling the droplet, which has the high degree of freedom in droplet control, does not contaminate/damage the sample, and is capable of being repeatedly used for a long time, and the method for controlling the droplet may be provided.

Also, according to the inventive concept, the vacuum tip may be adjusted in inner diameter and degree of vacuum to freely adjust the size and shape of the dimple and control the droplet volume.

The effects of the inventive concept are not limited to the foregoing effects. Other effects thereof will be clearly understandable by those skilled in the art from this specification and the accompanying drawings.

Foregoing embodiments are provided to help understanding of the inventive concept, but do not limit the scope of the inventive concept, and thus those with ordinary skill in the technical field of the inventive concept pertains will be understood that the inventive concept can be carried out in other specific forms without changing the technical idea or essential features. Therefore, the technical scope of protection of the inventive concept will be determined by the technical idea of the scope of the appended claims, and also will be understood as not being limited to the literal description in itself, but reaching the equivalent technical values of the inventive concept.

What is claimed is:

1. An apparatus configured to control a droplet, comprising:

a flexible substrate having at least one of a hydrophobic surface or an oleophobic surface, the flexible substrate being disposed horizontally; and a dimple formation unit configured to locally deform a bottom surface of the flexible substrate to form a dimple on the flexible substrate, the dimple formation unit including, a vacuum tip configured to suction the bottom surface of the flexible substrate to locally mechanically deform the flexible substrate, a driving unit configured to move the vacuum tip horizontally along the bottom surface of the flexible substrate so as to horizontally move the droplet within the dimple; and a control unit configured to control the vacuum tip and the driving unit.

2. The apparatus of claim 1, wherein the vacuum tip has a structure of a circular shaped cross section.

3. The apparatus of claim 1, wherein the vacuum tip is configured to contact with the bottom surface of the flexible substrate.

4. The apparatus of claim 1, wherein the dimple formation unit further comprises a vacuum adjusting part configured to adjust a pressure of a space between the vacuum tip and the flexible substrate.

5. The apparatus of claim 4, wherein the vacuum adjusting part is configured to adjust a degree of vacuum of the vacuum tip to adjust a shape of the dimple.

6. The apparatus of claim 1, wherein the dimple has a size that varies according to an inner diameter of the vacuum tip.

7. The apparatus of claim 1, wherein the dimple formation unit fixes the droplet within the dimple.

8. A method of controlling a droplet, comprising:

locally deforming a flexible substrate having at least one of a hydrophobic surface or an oleophobic surface to form a dimple on the flexible substrate which is disposed horizontally using a dimple formation unit, the dimple formation unit including, a vacuum tip configured to suction a bottom surface of the flexible substrate so as to locally mechanically deform the flexible substrate; and moving the vacuum tip horizontally along the bottom surface of the flexible substrate so as to horizontally move the droplet within the dimple.

9. The method of claim 8, wherein, in the forming of the dimple, a degree of vacuum of the vacuum tip is adjusted to adjust a shape of the dimple.

* * * * *